US006298524B1

(12) United States Patent
Officer

(10) Patent No.: US 6,298,524 B1
(45) Date of Patent: Oct. 9, 2001

(54) ENGINE KILL BAR HOLDING STRAP

(76) Inventor: Daryle Officer, 601 Wade Martin Rd., Edmond, OK (US) 73034

( * ) Notice: Subject to any disclaimer, the term of this patent is extended or adjusted under 35 U.S.C. 154(b) by 0 days.

(21) Appl. No.: 09/550,430

(22) Filed: Apr. 17, 2000

(51) Int. Cl.[7] ..... A44B 11/25
(52) U.S. Cl. ..... 24/306; 24/30.5 R
(58) Field of Search ..... 24/306, 442, 298, 24/299, 300, 301, 302, 324, 265 R, 265 EL, 305 R

(56) References Cited

U.S. PATENT DOCUMENTS

D. 297,683 * 9/1988 Beauchan ..... D3/100
3,501,774 * 3/1970 Norman ..... 24/306 X
4,047,651 * 9/1977 McMullen ..... 24/306 X
4,712,766 12/1987 Ehrenhalt .
4,874,151 10/1989 Fritz .
5,240,226 8/1993 Bobst .
5,347,835 9/1994 Dewey .
5,458,267 * 10/1995 Curtis et al. ..... 24/306 X
5,638,581 * 6/1997 Burke ..... 24/30.5 R
5,794,313 * 8/1998 Parsons ..... 24/306
5,920,965 * 7/1999 Kleban ..... 24/306 X

* cited by examiner

*Primary Examiner*—Robert J. Sandy
(74) *Attorney, Agent, or Firm*—Henderson & Sturm LLP

(57) ABSTRACT

An engine kill bar strap for holding the kill bar in the operating position adjacent the lawn mower handle. The strap includes a set of snap fasteners at one end spaced to engage when wrapped around the handle bar, and a set of hook and loop fasteners at the other end spaced to engage when wrapped around both the kill bar and the handle bar of the lawn mower.

8 Claims, 1 Drawing Sheet

ENGINE KILL BAR HOLDING STRAP

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of lawn mower accessories, and more particularly to a strap for holding the engine kill bar adjacent the handle bar of a lawn mower.

2. Description of Related Art

As can be seen by reference to the following U.S. Pat. Nos. 4,712,766; 4,874,151; 5,240,226 and 5,347,835 the prior art is replete with myriad and diverse holding straps.

While all of the aforementioned prior art constructions are more than adequate for the basic purpose and function for which they have been specifically designed, they are uniformly deficient with respect to their failure to provide a simple, efficient and practical strap for holding the engine kill bar of a lawn mower in the operating position.

As a consequence of the foregoing situation, there has existed a longstanding need for a new and improved engine kill bar holding strap and the provision of such a construction is a stated objective of the present invention.

BRIEF SUMMARY OF THE INVENTION

Briefly stated, the present invention provides an engine kill bar strap for holding the kill bar in the operating position adjacent the lawn mower handle. The strap includes a set of snap fasteners at one end spaced to engage when wrapped around the handle bar, and a set of hook and loop fasteners at the other end spaced to engage when wrapped around both the kill bar and the handle bar of the lawn mower.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
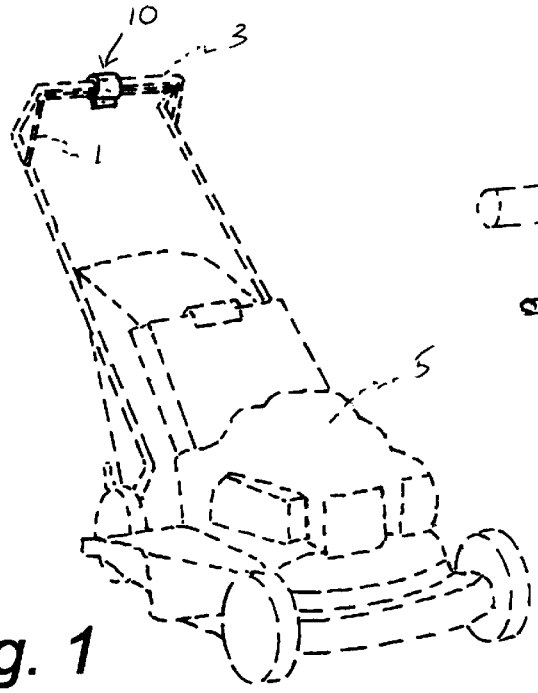
FIG. 1 is a perspective view showing the engine kill bar holding strap of the present invention secured around the kill bar and handle bar of a lawn mower.
Figure 2:
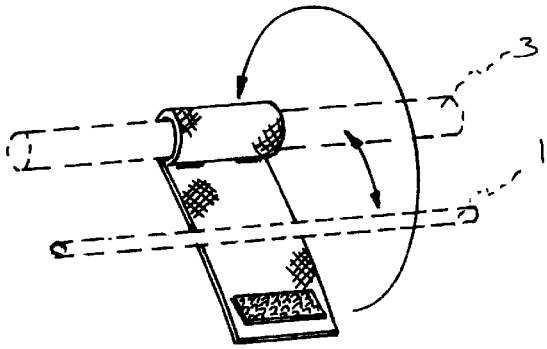
FIG. 2 is an enlarged partial perspective view showing the strap attached to the handle bar and in the process of being wrapped around the kill bar.

As can be seen by reference to the drawings, and in particularly to FIG. 1, the engine kill bar strap that forms the basis of the present invention is designated generally by the reference number 10. The strap 10 is designed to hold the engine kill bar 1 adjacent the handle bar 3 of a lawn mower 5 so that the engine will continue to run even when the operator is not in a position to simultaneously grasp the kill bar 1 and the handle bar 3. The strap 10 is made of a flexible strong fabric such as the material used for seat belt strips.

Figure 3:
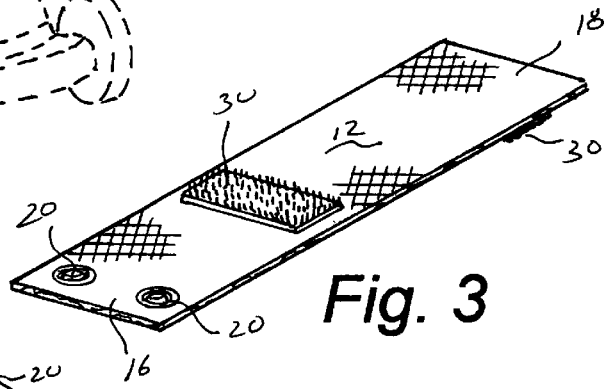
FIG. 3 is a perspective view showing one side of the strap.
Figure 4:
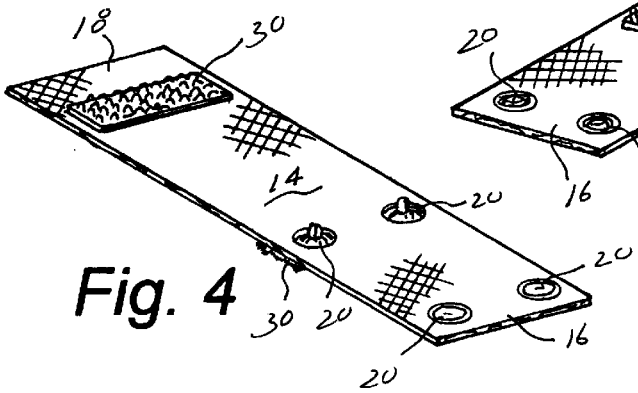
FIG. 4 is a perspective view showing the opposite side of the strap.

As best shown in FIGS. 3 and 4, the strap 10 includes first and second sides 12 and 14, and first and second ends 16 and 18. A set of mating snap fasteners 20 are carried on opposite sides 12 and 14 near the first end 16, and a set of mating hook and loop fasteners 30 are carried on opposite sides 14 and 12 near the second end 18. The spacing of the snap fasteners 20 is such that they will engage when the first end 16 of the strap 10 is wrapped around the handle bar 3. The spacing of the hook and loop fasteners 30 is such that they will engage when the second end 18 of the strap 10 is wrapped around both the kill bar 1 and the handle bar 3.

Figure 5:
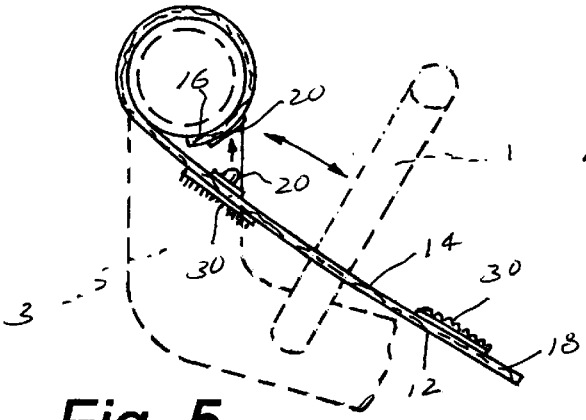
FIG. 5 is a side elevational view showing one end of the strap wrapped around the handle bar with the snap fasteners about to engage, and the other end of the strap in position under the kill bar.
Figure 6:
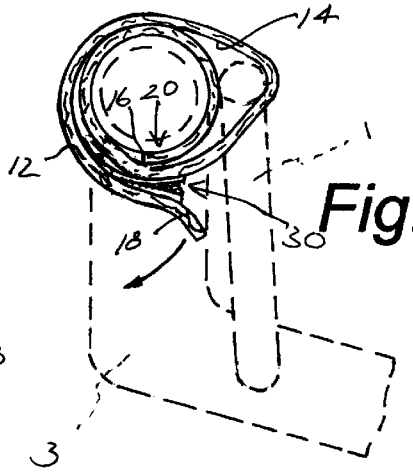
FIG. 6 is a side elevational view showing one end of the strap wrapped around the handle bar with the snap fasteners engaged, and the other end of the strap wrapped around both the kill bar and the handle bar with the hook and loop fasteners engaged.

In use, the first end 16 of the strap 10 is secured to the handle bar 3 by snap fasteners 20 (FIG. 5). Then the second end 18 of the strap 10 is wrapped around the kill bar 1 and the handle bar 3 and secured in position by engagement of the hook and loop fasteners 30 (FIG. 6).

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A device for holding an engine kill bar adjacent a handle bar of a lawn mower, the device comprising:

an elongated flexible strap having a first side, a second side, a first end, and a second end;

a first set of mating fasteners, one of the first set being disposed adjacent the first end on the first side of the strap, and the other of the first set being disposed on the second side of the strap at a position spaced in from the first end a distance sufficient to allow the engagement of the first set of fasteners when the strap is wrapped around the handle bar of the lawn mower; and a second set of mating fasteners, one of the second set being disposed adjacent the second end on the second side of the strap, and the other of the second set being disposed on the first side of the strap at a position spaced from the second end a distance sufficient to allow the engagement of the second set of fasteners when the strap is wrapped around both the engine kill bar and the handle bar of the lawn mower.

2. The device of claim 1 wherein the first set of fasteners are snaps.

3. The device of claim 1 wherein the second set of fasteners are hook and loop fasteners.

4. The device of claim 2 wherein the second set of fasteners are hook and loop fasteners.

5. The device of claim 1 wherein the strap is made of fabric.

6. The device of claim 2 wherein the strap is made of fabric.

7. The device of claim 3 wherein the strap is made of fabric.

8. The device of claim 4 wherein the strap is made of fabric.

* * * * *